US005635898A

United States Patent [19]

Walters et al.

[11] Patent Number: 5,635,898

[45] Date of Patent: Jun. 3, 1997

[54] FIRE SOUND SIMULATOR AND RELATED TRANSMISSIONS

[75] Inventors: Jon S. Walters, St. Louis, Mo.; James Blackford, Vanderburgh, Ind.

[73] Assignee: American General Products, Inc., Maryland Heights, Mo.

[21] Appl. No.: 255,921

[22] Filed: Jun. 7, 1994

[51] Int. Cl.[6] ..... G08B 3/10

[52] U.S. Cl. ..... 340/384.7; 340/692; 340/515; 40/428; 200/61.02; 472/57

[58] Field of Search ..... 472/57, 64, 65; 340/692, 515, 825.69; 40/428; 200/61.02

[56] References Cited

U.S. PATENT DOCUMENTS

| | | | |
|---|---|---|---|
| 3,526,984 | 9/1970 | Nielsen et al. | 40/428 |
| 3,723,046 | 3/1973 | Poling et al. | 431/18 |
| 4,026,544 | 5/1977 | Plambeck et al. | 472/64 |
| 4,733,215 | 3/1988 | Memmola | 340/539 |
| 4,973,941 | 11/1990 | Davis et al. | 340/384.7 |
| 5,049,107 | 9/1991 | De Nittis | 446/397 |
| 5,099,591 | 3/1992 | Eiklor et al. | 40/428 |

*Primary Examiner*—Jeffery Hofsass
*Assistant Examiner*—Daryl C. Pope
*Attorney, Agent, or Firm*—Paul M. Denk

[57] ABSTRACT

A fire sound simulator includes a random sequencer which produces random signals. The sequencer is connected to a sound synthesizer which transforms the sequencer's signals into random sounds. The synthesizer is in turn connected to a speaker which receives the sounds from the synthesizer for outputting the sounds. The simulator alternatively includes a recording stored on a ROM chip. The simulator may be activated by a light sensitive switch.

9 Claims, 2 Drawing Sheets

FIRE SOUND SIMULATOR AND RELATED TRANSMISSIONS

BACKGROUND OF THE INVENTION

This invention relates to fire sound simulators which may be used in conjunction with home fireplaces, or other structures.

Many homes are now built with gas fireplaces which do not burn wood. For the purposes of appearances, "logs" are placed in the fire place. Such fireplaces do not produce the sounds of fire. Many people enjoy these sounds and find them relaxing.

Devices which produce fire sounds have been made. U.S. Pat. No. 5,099,591 to Eiklor et al produces fire sounds using a reed which is randomly flexed away from a striker plate and released to hit the striker plate.

U.S. Pat. No. 4,026,544, to Plambeck et al., simulate the sound of fire by the moving interaction of two pieces of material, one piece having looped fibers and the other having hooked fibers.

U.S. Pat. No. 3,723,046, to Polig et al, uses a tape and cassette player to provide the sounds of a crackling fire to their simulated fire apparatus.

U.S. Pat. No. 3,526,984, to Nielsen et al, produces fire sounds by brushing a rotating finger member across the surface of a second member.

All of these devices have the drawback that they are all mechanically operative.

SUMMARY OF THE INVENTION

One object of this invention is to provide a fire sound simulator.

Another object is to provide such a simulator which is electrical, rather than mechanical.

These and other objects will become apparent to those skilled in the art in light of the following disclosure and accompanying drawings.

Briefly stated, a simulator produces the sounds of a wood burning fire. The simulator includes a source of power, a switch to activate and deactivate the simulator, a random sequencer which produces random signals, and a sound synthesizer which receives the sequencer signals and transforms them into random sounds, and a speaker which receives the sounds for the synthesizer which outputs the sounds. The simulator may include a rectifier and a filter capacitor, operative through electronic circuitry, to produce hissing and popping sounds indicative or simulative of a fire. The switch is a light sensitive switch which activates said simulator when exposed to light, and there is included a mylar or piezo speaker.

In another embodiment, the simulator includes a recording of fire sounds which is played when the simulator is activated. The recording providing the simulated sound is recorded in a ROM chip. Obviously, any type of sounds could be recorded and transmitted through usage of this device.

The device may include acadian devester cell, or other sensitive means, wherein light, flame, movement or sound can activate the device, to provide for its transmission of noise. For example, when the cell detects flame, as in a log burning or gas log burning fireplace, that may activate the operations of this sound transmitter. The device may operate off a series of "DC" batteries, or perhaps be plugged into the 110 volt source. The system is designed and can be used with a remote control, a manual switch, or the light sensor, as previously explained. The total electronic package for this device can be factory installed, or added as an optional feature on all gas log sets, without wiring or alteration of existing gas log systems. The sound system is totally safe when installed within a fibrous heat resistant ceramic simulated log, or pine cone, as explained in this application, or when mounted in the vicinity of the air intake of the fire box, in order to provide for its maintenance of cooling. A piezo speaker may be installed in the device to provide for the transmission of the recorded sound.

DESCRIPTION OF THE PREFERRED EMBODIMENT

Figure 1:
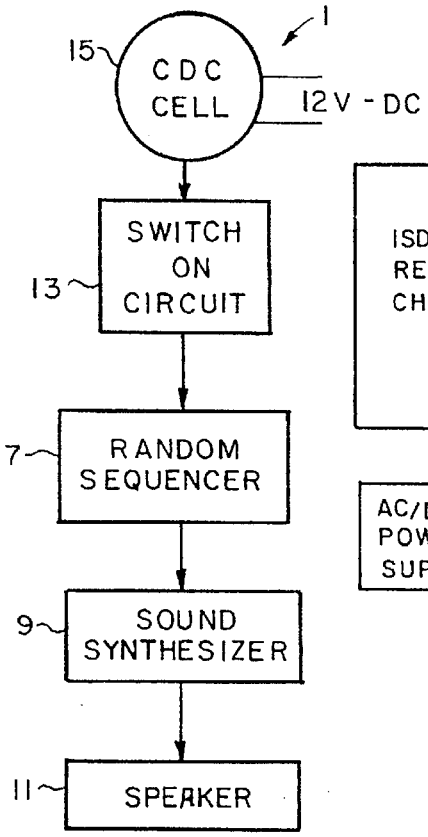
FIG. 1 is a block diagram of a fire sound simulator of the present invention.
Figure 3:
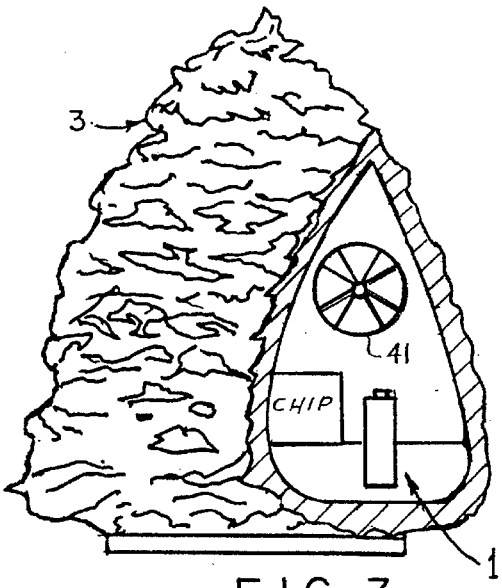
FIG. 3 is a perspective view, partially cut away of the fire sound simulator embodied in a decorated pine cone.
Figure 4:
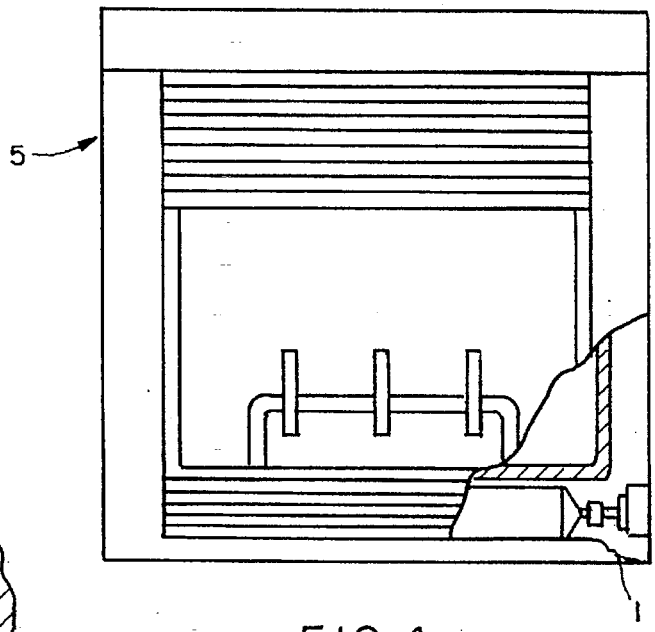
FIG. 4 is a front elevational view, partially cut away showing the simulator built into a fire place.

Referring to the figures, a fire sound simulator 1 of the present invention is diagramatically shown in FIG. 1. The simulator 1 is small so that it may be incorporated into a decorative pine cone 3, or the like, or directly into a fire place 5, as shown in FIGS. 3 and 4. For example, the unit may be only 1.5" by 2" by 0.75".

As shown in FIG. 1, simulator 1 includes a random sequencer 7 which delivers a signal to a sound synthesizer 9. Synthesizer 9 is connected to a speaker 11 which emits the fire sounds. Speaker 11 may be a piezo speaker, or it may be of the mylar, alnico, or ferrite type. Simulator 1 can be powered by batteries, such as a 9 or 12 volt or "AA" size batteries. Or, it can be plugged into a wall outlet. It can be provided with a switch on circuit 13 so that the simulator may be used with a remote control, manual on/off switch, or a light sensor 15.

The random sequencer and synthesizer define a circuit that hisses, pops, and crackles in a pseudo random fashion to simulate fire sounds. The use of a sequencer has the advantage that it does not repeat exact sounds, but rather has a flow of sound which simulate the sound of a wood burning fire.

In a second embodiment, a fire sound reproduction unit replaces the sequencer of simulator 1. The sound reproduction unit uses a recording of an actual burning fire. The recording is short, for example twenty seconds long, and is continuously repeated. However, rather than maintaining the recording on a cassette and using a cassette player, the recording is stored in a memory unit which is mounted on a PC board.

Neither the simulator nor the reproducer use mechanical devices to simulate the sounds of a burning wood fire. Rather, the sounds are electrically produced from either a circuit or a memory storage.

This invention utilizes new technology of sound recording to produce, in this particular instance, approximately 20 seconds, more or less, of an actual fire sound. This sound may then be repeated. This is particularly useful, as previously explained, for application in combination with a gas log fireplace, where sound is not normally produced. The unique circuitry of this invention allows the recorder to cycle continuously, once initiated. The unit simulates the fire sound by a circuit that furnishes the hissing, popping, and crackles in pseudo random fashion. The object is to provide an exact sound of a burning fire, and to provide continuity of sound during its transmission. Both in the original and modified units, the devices may be powered by a 9 volt battery, incorporate a manual switch to provide for its initiation, or be rendered operative by means of an automatic switch, as previously explained. Furthermore, the units may be powered from additional power sources, such as a 5 to 35 volts DC battery supply, or rectified current, or from 10 to 40 volts AC and up to 110 volts AC line voltage, with the appropriate power transformer. The use of the additional rectifiers and filter capacitors are provided to provide for proper transmission, playback, and clarity of transmitted sound.

In the circuit board for the device it is preferable that surface mount components may be applied to the circuit board, so as to reduce both the size of the boards, and particularly the sound recorder board. The components are quite compact in assembly, so that it may be embodied within a small unit, such as that equivalent to the size of a pine cone, to provide for its proximity within the fire box, as previously shown in FIG. 3. Since the speaker itself is the largest component of this particular unit, it is likely that the microcircuitry utilized could be of such small size as to mount directly upon the speaker, within its assembly within the display item, such as the pine cone, when assembled. Obviously, though, when prepared in the OEM application, the device may simply be mounted within the fireplace itself, when constructed, or when installed, being of a portable type. The circuitry of this device can also be included with an AC line transformer to operate directly from the 110 volts AC, normally available in the home. Or, the circuitry may be provided in a contained unit as a part of the existing gas log device, of the fireplace unit, or even as a stand alone item. A simulator circuit is built into the AC powered unit. Volume control and sound select in addition to power on/off automation are included as examples of additional options available with the simulator circuitry of this device. The memory of the recorded fire sound is held in a nonvolatile ROM. This means that the memory will not be lost when the battery is disconnected. It is desired that the memory should have some longevity, preferably of approximately ten (10) years, without being connected to a battery. Various types of fire sounds, really of an infinite variety, may be recorded into the recorder unit. The programming device of this invention is designed to store the fire sound information on its memory chip.

Figure 2:
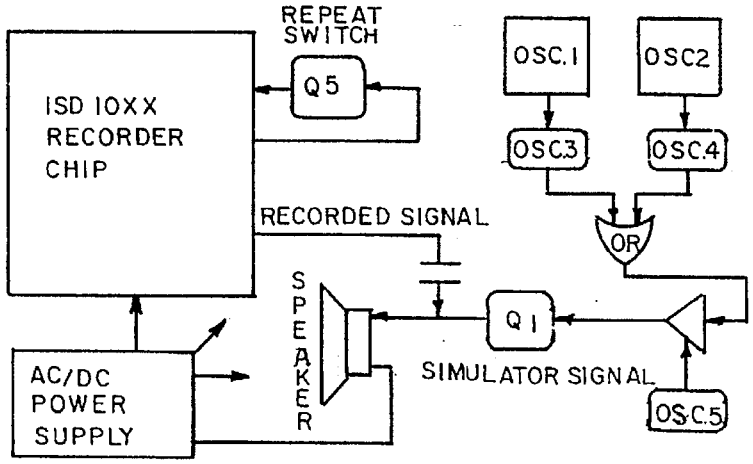
FIG. 2 is a schematic diagram of the circuitry for the hybrid type of fire sound simulator of this invention.

The particular circuitry provided for furnishing the operations of the electronic chip, for use producing the simulated fire sound, is shown in FIG. 2, as previously explained. As can be seen, this fire sound simulator utilizes solid state electronic circuitry to produce the sound of a fireplace type fire, and which furnishes both the crackling noise of a vigorously burning fire, in addition to whatever hissing noises normally accompanying the burning of logs, such as pine logs, pine cones, or the like. The circuit reproduces background noise, while another circuit generates random popping noises to provide that type of random sound pattern. In addition, it is likely that these various sounds could be regulated from a remote control, to govern the type of sounds that may be generated by the circuitry of this device.

FIG. 2 discloses a block or schematic diagram of the high bred type fire sound simulator of this invention. As can be noted, it includes its power supply, which can operate on either AC line power or DC power from a battery, or perhaps AC power that has been rectified by a direct current power supply. It includes a recorder chip, as noted, and which has provided in its integrated circuitry the various simulating fire sounds that are to be generated, combined, sequenced, and then transmitted for broadcasting by the shown speaker. A transistor Q5 provides for the repeat of the background sound that is generated by the recorder chip. The oscillator circuits 1 through 4 produce the popping noises that simulate a component of log burning fire sounds, and pass through an OR gate to furnish the proper combination of signals representative of the generated sounds, and which are then conducted to an oscillator 5, where the signal is transformed into a triangular form of output signal, further processed by the transistor Q1, and delivered for combining with the recorded signal to the speaker, as noted.

Figure 5:
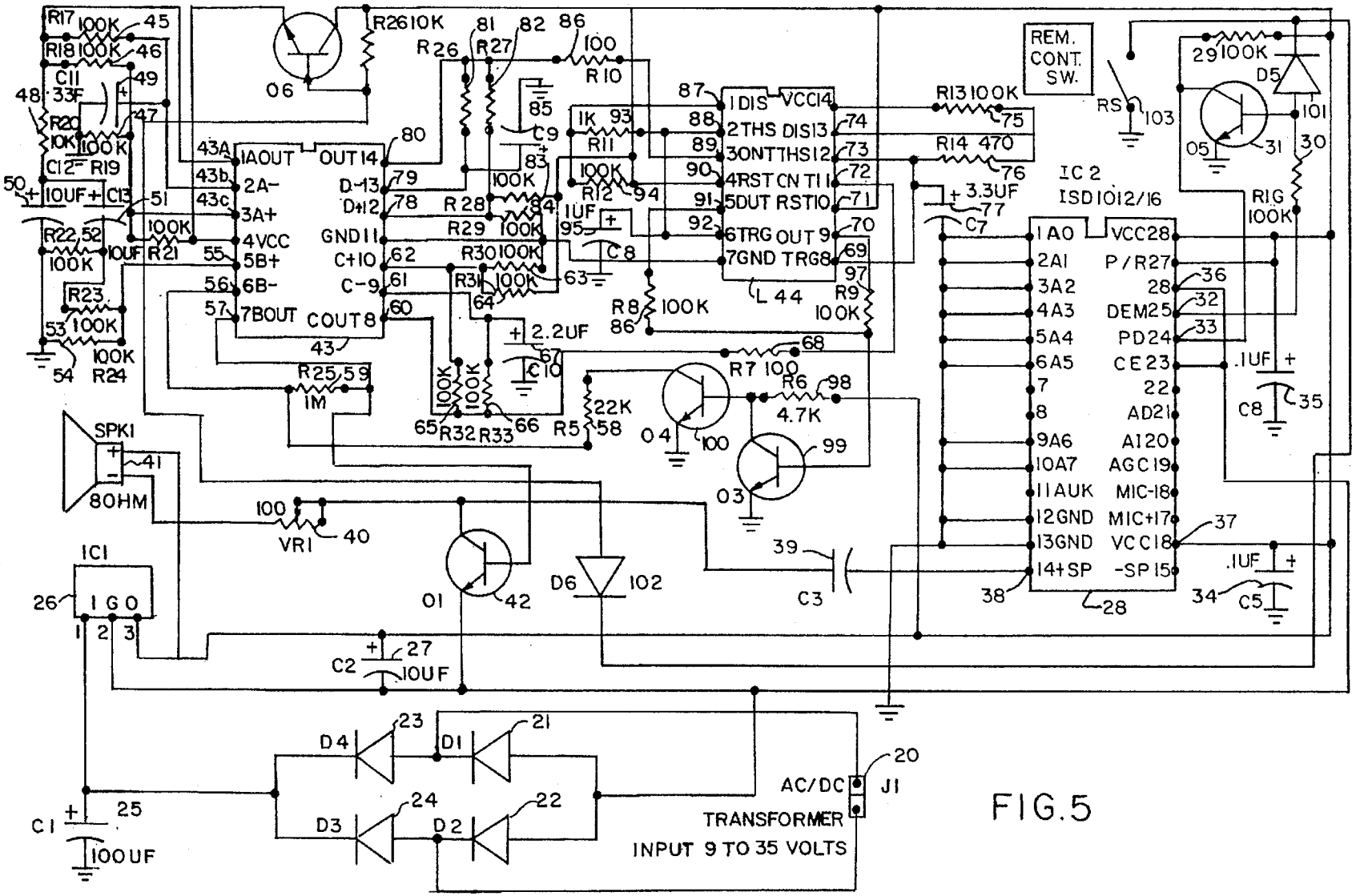
FIG. 5 is an electrical schematic of the fire sound simulator.

The particular circuitry shown in FIG. 2 is that which is used and which is powered from alternating current, but it would be easy to provide for the battery type of power, to convert this to a DC circuit, to furnish a simulator of that design. The circuitry described herein, in referring to FIG. 5, is that for the AC input circuit. As can be seen, this circuitry includes that which is generally depicted in the block diagram of FIG. 1. The power for operations of this circuitry, and whether it be alternating current of 110 volt capacity, and which has been stepped down to a 24 volt or 9 volt AC, through the use of a step down transformer, or the like, enters the circuitry at connector 20. It is then rectified by the diodes 21 through 24, and then filtered by means of the capacitor 25. The regulator 26 regulates the voltage to 5 volts DC, and this voltage is utilized throughout the circuitry, for powering the various electronic components, and will normally be referred to as the +5 volts, throughout this description. The capacitor 27 prevents the generation of any oscillations in the voltages generated through the regulator 26, and adds to the filtering of the developed +5 V.

The integrated circuit 28 provides the background noise for this sound simulator. It does this because the sound of an actual fire has been recorded into this circuitry. This type of integrated circuit or chip may be obtained from Information Storage Devices, of San Jose, Calif., under Model No. ISD1012. This memory 28 is nonlvolatile, and has been created to produce a 12 second sound in duration. This sound is then repeated, so that the recording is played back continuously, because the resistors 29 and 30, in addition to the transistor 31, reset the integrated circuit 28 when the end message pin of the IC, that being the pin 32, goes low. With this pin 32 going low, or dropping off to 0 volts, it causes the transistor 31 to likewise shut off. When the transistor shuts off, voltage is applied to the pin 33, of the integrated circuit 28. This voltage as applied to pin 33 causes the integrated circuit 28 to reset, and to start playing the recording of the fire simulated sound, once again, for repeat broadcasting. The capacitors 34 and 35 decouple the +5 V, before it is applied to the pins 36, and 37, to reduce the noise in the playback mode.

The audio signal generated from the integrated circuit 28 is outputted upon the pin 38, and this signal is coupled through the capacitor 39 to a variable resistor 40. At this location, the signal is combined with the random popping noise, as to be subsequently described. The variable resistor 40 controls the volume by limiting the amount of current allowed to pass to the speaker 41. The variable resistor 40 is connected to the negative terminal (–) of the speaker 41. The positive terminal (+) is connected to the +5 V generated through the regulator 26.

The transistor 42 buffers the popping noise signal from the integrated circuits 43 and 44, and their associated circuitry. The integrated circuit, or chip, 43 is configured incorporating three oscillators and an amplifier. The first oscillator consists of pins 43A, 43B, and 43C, in addition to the resistors 45, 46, 47, and 48, and the capacitor 49. The output signal from the oscillator is from the pin 43A, and this signal is buffered by the capacitors 50, and 51. In addition, the signal is further buffered by the resistors 48, 52, 53, and 54.

It is to be commented herein that the integrated circuit 43, in addition to the integrated circuit 44, are both available from Hamilton/Hallmark, located in Peabody, Mass. under Model Nos. NE556N(44) and LM32YN(43).

The buffered signal from the previously identified circuitry is applied to the amplifier of pins 55, 56, and 57, and is additionallly applied to resistors 58 and 59. This signal is buffered to a low level triangle wave that goes above and below ground (0 volts). The signal controls the level of the popping noise, when it occurs.

The sound that simulates a popping noise, as previously explained, is generated by the two oscillators of the integrated circuit 43, and the two voltage controlled oscillators of the integrated circuit 44, and their associated circuitry. The pins 60, 61, and 62, of integrated circuit 43, along with the resistors 63, 64, 65, and 66, in addition to the capacitor 67, form an oscillator. Its signal is sent through the resistor 68 to vary the frequency of the voltage controlled oscillator, as made up by the pins 69 through 74, of the integrated circuit 44, in addition to the resistors 75 and 76, in addition to the capacitor 77, as noted.

The pins 78, 79, and 80, in addition to the resistors 81, 82, 83, and 84, and the capacitor 85 form yet another oscillator. Its signal is outputted on the pin 80, and passes through the resistor 86 to vary the frequency of the other voltage controlled oscillator. This oscillator is made up of the pins 87 through 92 of the integrated circuit 44, in addition to its asociated resistors 93 and 94, in addition to the capacitor 95.

The output signals of these two voltage controlled oscillators are combined with a discrete form of an OR gate. This means that only when both inputs of the OR gate go low, will the output go low (0 volts). Therefore, only when the outputs of both of the voltage controlled oscillators go low, wil a low level be produced on the output of the OR gate. This low pulse often varies in width and occurs in a random fashion.

Components that form the discrete OR gate are the resistors 96, 97 and 98, and the transistors 99 and 100. The pulse from this OR gate is applied to the amplifier circuit of the integrated circuit 43, by way of its resistor 58. The resistor 58, in addition to the resistor 59, set the gain of the amplifier when the end of resistor 58 that is connected to the transistor 100 (of the discrete OR gate) goes low.

The amplifier will only amplify when the random pulse happens and the signal to be amplified is the triangle wave that is applied to pin 56, and goes slightly above and below ground (0 volts). This causes a random popping noise that varies in width and level because the random pulse briefly amplifies a section of the generated triangle wave that could be at the highest peak, or so low it is not audible depending upon when in the cycle the popping noise occurs. This varying random pop is buffered through the transistor 42, where it is combined with the realistic background noise as previously generated, to add a random component to the sound.

The foregoing explains the function of the sound generated circuitry of this development. Control circuitry has been added to allow a remote control system to control whether the sound is on or off. This control circuitry consists of the diodes 101, and diode 102, in addition to the resistor 81, and the transistor 31, as previously described.

When the remote switch, as at 103, is open, the circuit is on and functions normally. When this remote switch 103 is closed, it causes a reset signal to stay in the power shut-down mode and the background noise is eliminated. Also, the closed remote switch 103 causes the transistor 31 to bias off, which shuts off the voltage to the integrated circuit 43, and causes the popping sound generating circuit to also shut down. In this shut-down mode less power is used by the circuitry and no noise is heard from its speaker, as at 41. When the remote switch 103 is opened, the sound resumes and the circuit functions normally.

The foregoing provides a detailed description of the components of the circuitry of this invention, which provides the type of fire sound noise as desired, and further explains the circuitry facilitating the operations of this device, to generate this background noise. This is an all solid state electronic fire sound simulator noise, with its ability to be remotely controlled, and its combination of a recorded sound, within integrated circuits, and a random popping sound, also within an integrated circuit, to create a realistic random sound emanating from the speaker of this circuitry.

The foregoing description is set forth for illustrative purposes only, and is not meant to be limiting. Variations within the scope of the appended claims may be apparent to those skilled in that art.

Having thus described the invention what is claimed and desired to be secured by Letters Patent is:

1. A sound simulator which produces the sounds of a wood burning fire, the simulator including a source of power, a switch to activate and deactivate the simulator, a recording of fire sounds which is played when the simulator is activated, said recording being stored in an integrated circuit, said integrated circuit capable of producing signals when activated, a speaker which receives the signal from the integrated circuit to produce audible sounds representative of a wood burning fire, said switches capable of activation or deactivation from a remote source, said sound simulator includes electrical circuitry for processing generated voltages received from a power source, a first integrated circuit preprogrammed to produce fire background noises when energized, in time sequence, and at least another integrated circuit for generating pre-recorded popping noises simulating of a fire, in sequence, both of the voltages generated from said integrated circuits being amplified and delivered to said speaker, for broadcasting of a sound that simulates the sound of a log burning fire.

2. The invention of claim 1 wherein said power source for the simulator is house voltage.

3. The invention of claim 1 wherein said power source for the simulator is an electric battery.

4. The invention of claim 2 wherein said house voltage is approximately 110 volts, and said electrical circuitry includes a step down transformer for reducing the 110 voltage to a lower level for processing and functioning of the electronic circuitry of this simulator.

5. The simulator of claim 1 wherein the random sequencer includes a rectifier and a filter capicitor.

6. The simulator of claim 5 wherein the switch is a light sensitive switch which activates said simulator when exposed to light.

7. The simulator of claim 1 wherein the speaker is one of Mylar, Alnico, and Ferrite.

8. A sound simulator which produces the sounds of a wood burning fire, the simulator including a source of power, a switch to activate and deactivate the simulator, a random sequencer which produces random signals, and a sound synthesizer which receives the sequencer signals and transforms them into random sounds, said sequencer including a rectifier and a filter capacitor, a speaker which receives the sounds for the synthesizer which outputs the sounds, and said switch is a light sensitive switch which activates said simulator when exposed to light.

9. The simulator of claim 8 wherein the speaker is one of Mylar, Alnico, and Ferrite.

* * * * *